US011572716B2

(12) United States Patent
Heyduck et al.

(10) Patent No.: US 11,572,716 B2
(45) Date of Patent: Feb. 7, 2023

(54) LOCK ACTUATION DEVICE HAVING AN EMERGENCY OPENING FUNCTION

(71) Applicant: DAIMLER AG, Stuttgart (DE)

(72) Inventors: Jan Heyduck, Sindelfingen (DE); Juergen Jooss, Böblingen (DE); Tobias Konrad, Böblingen (DE); Martin Lindmayer, Sulz (DE)

(73) Assignee: MERCEDES-BENZ GROUP AG, Stuttgart (DE)

( * ) Notice: Subject to any disclaimer, the term of this patent is extended or adjusted under 35 U.S.C. 154(b) by 287 days.

(21) Appl. No.: 16/758,761

(22) PCT Filed: Jun. 20, 2018

(86) PCT No.: PCT/EP2018/066450
§ 371 (c)(1),
(2) Date: Apr. 23, 2020

(87) PCT Pub. No.: WO2019/081074
PCT Pub. Date: May 2, 2019

(65) Prior Publication Data

US 2020/0340275 A1 Oct. 29, 2020

(30) Foreign Application Priority Data

Oct. 24, 2017 (DE) ..... 10 2017 009 902.2

(51) Int. Cl.
*E05B 81/14* (2014.01)
*E05B 81/20* (2014.01)
(Continued)

(52) U.S. Cl.
CPC ..... *E05B 81/14* (2013.01); *E05B 81/21* (2013.01); *E05B 79/20* (2013.01); *E05B 81/58* (2013.01); *E05Y 2900/531* (2013.01)

(58) Field of Classification Search
CPC ..... E05B 81/14; E05B 81/21; E05B 81/58; E05B 79/20; E05Y 2900/531
See application file for complete search history.

(56) References Cited

U.S. PATENT DOCUMENTS 6,439,623 B1 8/2002 Lohfeld et al.
6,540,270 B1 4/2003 Reddmann
(Continued)

FOREIGN PATENT DOCUMENTS

CN 103502550 A 1/2014
CN 104631991 A 5/2015
(Continued)

OTHER PUBLICATIONS

Office Action dated Nov. 4, 2020 in related/corresponding CN Application No. 201880069017.9.
(Continued)

*Primary Examiner* — Christine M Mills
*Assistant Examiner* — James E Ignaczewski
(74) *Attorney, Agent, or Firm* — Patent Portfolio Builders PLLC

(57) ABSTRACT

A device and a method for opening and closing a motor vehicle door having a door lock. The device includes an electric opening actuator and an electric closing actuator, by means of which the door lock can be brought from a pre-locking position into a final-locking position. A control device controls the opening and closing actuators. The control device, in the event of a door opening request during operation of the closing actuator, first switches the closing actuator into a reversing mode, in which the door lock can be moved again in the opening direction and the opening actuator is triggered after a predetermined period of time.

15 Claims, 3 Drawing Sheets

Figure 1:
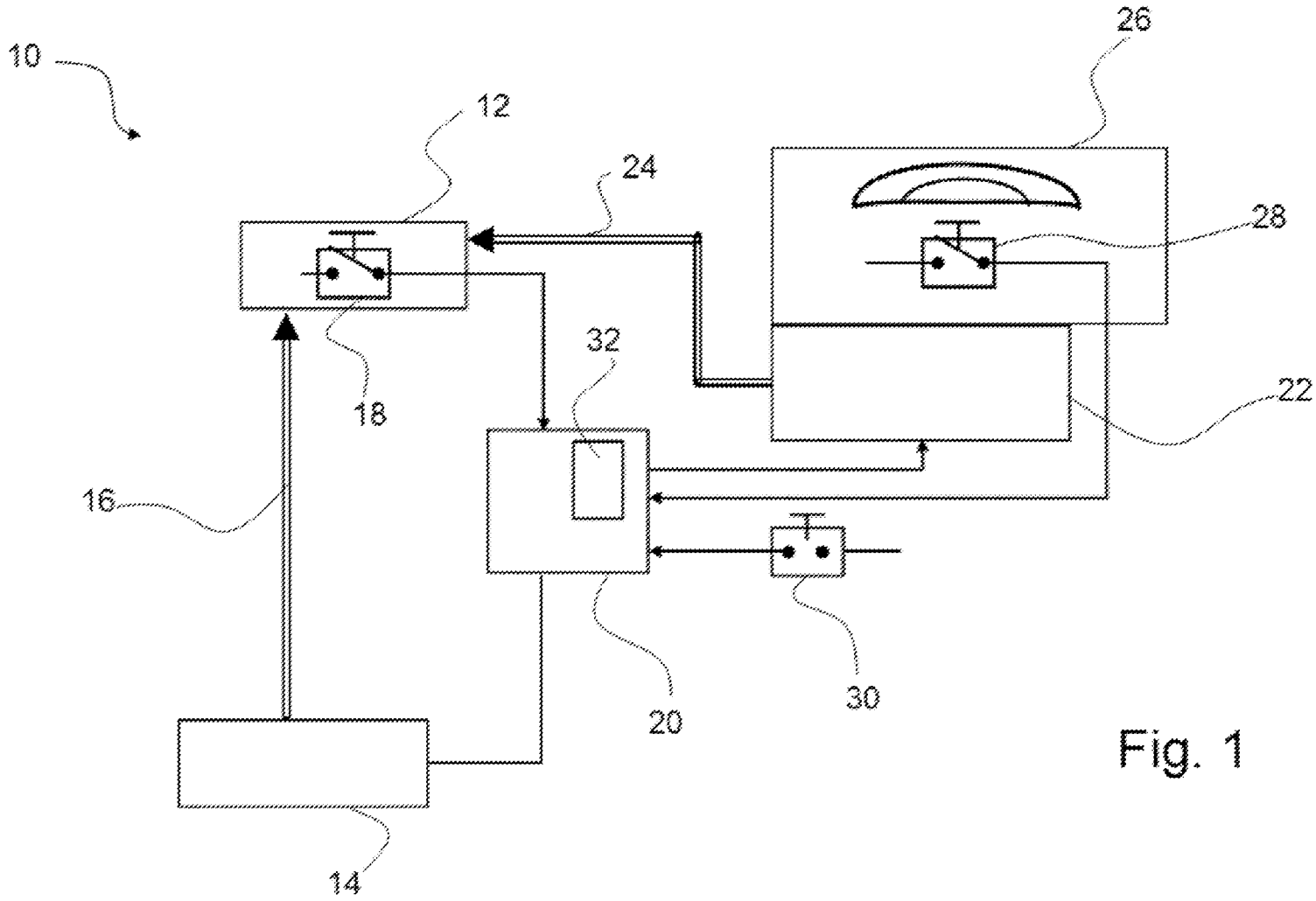

(51) Int. Cl.

| | |
|---|---|
| *E05B 79/20* | (2014.01) |
| *E05B 81/58* | (2014.01) |

(56) References Cited

U.S. PATENT DOCUMENTS

| | | | | |
|---|---|---|---|---|
| 6,581,990 | B1 | 6/2003 | Menke et al. | |
| 8,534,743 | B2 | 9/2013 | Scheler | |
| 9,484,914 | B2 * | 11/2016 | Pohl | B60J 5/00 |
| 9,810,004 | B2 * | 11/2017 | Scholz | E05B 81/20 |
| 10,119,308 | B2 * | 11/2018 | Linden | E05B 77/48 |
| 10,871,011 | B2 * | 12/2020 | Rosales | E05B 79/20 |
| 2003/0080569 | A1 | 5/2003 | Raymond et al. | |
| 2005/0082842 | A1 * | 4/2005 | Warmke | E05B 81/14 292/216 |
| 2015/0121758 | A1 * | 5/2015 | Pohl | B60J 5/00 49/506 |

FOREIGN PATENT DOCUMENTS

| | | | | |
|---|---|---|---|---|
| DE | 19904663 | A1 | 8/2000 | |
| DE | 19955883 | A1 | 5/2001 | |
| DE | 19957061 | A1 | 5/2001 | |
| DE | 102004034628 | A1 | 2/2006 | |
| DE | 102010054975 | B3 * | 2/2012 | E05B 81/14 |
| DE | 102010054975 | B3 | 2/2012 | |
| DE | 102011012656 | A1 | 8/2012 | |
| EP | 1101886 | A2 | 5/2001 | |
| EP | 1103677 | A2 | 5/2001 | |
| WO | 2005093195 | A2 | 10/2005 | |

OTHER PUBLICATIONS

International Search Report dated Oct. 9, 2018 in related/corresponding International Application No. PCT/EP2018/066450.
Written Opinion dated Oct. 9, 2018 in related/corresponding International Application No. PCT/EP2018/066450.

* cited by examiner

LOCK ACTUATION DEVICE HAVING AN EMERGENCY OPENING FUNCTION

BACKGROUND AND SUMMARY OF THE INVENTION

Exemplary embodiments of the invention relate to a device for opening and closing a motor vehicle door having a door lock, which is provided with an electric opening actuator and an electric closing actuator, by means of which the door lock can be brought out of a first pre-locking position into a final-locking position, further comprising a control device for controlling the opening actuator and the closing actuator. Exemplary embodiments of the invention further relate to a motor vehicle door having such a device and a motor vehicle having at least one such motor vehicle door. Finally, exemplary embodiments of the invention relate to a method for opening and closing a motor vehicle door by means of such a device.

Such lock operating devices are well-known and widespread. These usually comprise a door lock that can be opened by an electric opening actuator triggered by a door handle. To close a vehicle door, modern lock operating devices also have a closing actuator to bring the door from a pre-locking position to a final-locking position. The user no longer needs to "firmly" close or slam the door, but only needs to bring it into the pre-locking position, in which a rotary latch of the door lock is operated. When the pre-locking position is reached, the aforementioned closing actuator for the door lock is triggered by a switch, which pulls the door lock fully closed and brings it into the final-locking position. The vehicle door is then closed a few millimeters against the force of the door seals. This "closing process" typically takes a few hundred milliseconds to move the door lock from the pre-locking position to the final-locking position.

DE 10 2010 054 975 B3 discloses a device for opening and closing a motor vehicle door having a door lock with a lock actuating device, which can be operated in a reversing operation, i.e., can be switched to an opening operation by a signal during a closing operation.

DE 10 2004 034 628 A1 discloses a motor vehicle lock having an auxiliary opening actuator and an auxiliary closing actuator, wherein the auxiliary closing actuator is also operated for a short time during an opening process to relieve a pawl.

Conventional door locks are known from DE 199 57 061 A1 and DE 199 55 883 A1.

If, however, the door handle is operated by the user during this closing process with the intention of opening the door again immediately, i.e., to provide an emergency opening function, for example, if fingers or objects are jammed, conventional lock operating devices unlock the door lock mechanically by means of a door handle mechanically coupled via a Bowden cable. Since considerable forces in the region of several hundred Newton occur in the door lock during the closing process, such an opening process during the electrical opening process leads to large strains and thus to an increased wear in the door lock and sometimes to unpleasant noises.

Thus, exemplary embodiments of the invention are directed to preventing these negative effects in the case of an emergency door opening and to provide a lock operating device and a method for operating this, which enables the door to be opened during the closing process without generating noise and while avoiding increased wear.

In light of the generic device, according to embodiments, the control device is designed, in the event of a door opening request during operation of the closing actuator, to firstly switch the closing actuator into a reverse mode in which the door lock can be moved again in the opening direction and the opening actuator can be triggered after a predetermined period of time.

Due to the predetermined time period before the opening actuator is put into operation, not only is there less tension on the mechanism of the door lock, but the rotatory latch and its catches can also become tension-free during this period. As a result, the opening noises and the wear in the door lock are considerably reduced. The catches do not need to be released under tension. Finally, the opening actuator can also be designed to be weaker and the "emergency opening" provided here can still be implemented. The motor of the opening actuator is also subject to less wear. The door opening request can come from an external door handle, an internal door handle or by means of a switch or a control device.

Preferably the predetermined time span is between 20 msec and 200 msec, particularly preferably between 60 msec and 120 msec.

According to an advantageous embodiment of the invention, the opening actuator can be activated by a switching signal triggered by a door handle. By this known controlling of the opening actuator by a microswitch attached to the door handle, which triggers after a short distance when the door handle is pulled, a comfortable operation of the door lock is achieved for the user.

In addition, according to an advantageous development, the door handle can be mechanically coupled directly to the door lock parallel to the electrical opening actuator. This is achieved, in particular, by means of a Bowden cable attached to the door handle and the door lock. This makes it possible to force an immediate opening of the door in case of an emergency opening, e.g., in the case of trapped limbs, as neither the predetermined time period according to the invention nor a system-related delay necessary to the opening actuator has to be waited for, but rather an opening of the door can take place without delay.

According to a further advantageous embodiment of the invention, the opening actuator can be activated by a switching signal that can be triggered by a switch, wherein the switch can be mounted in the vehicle interior or in a remote control. Thus, the emergency opening according to the invention can also be triggered by a user inside the vehicle.

According to a further advantageous embodiment of the invention, the opening actuator can be activated either alternatively or additionally by a switching signal that can be triggered by a programmed control system. This enables an emergency opening if the control system detects a corresponding state.

According to the invention, a motor vehicle door is also provided, which comprises an embodiment of the device described above.

According to the invention, a motor vehicle is also provided, which comprises at least one motor vehicle door having the described device. Preferably, all motor vehicle doors of the motor vehicle are designed correspondingly.

Exemplary embodiments of the invention are further directed to a method in which, in the case of an opening request during the operation of the closing actuator, the closing actuator is first switched to a reversing mode in which the door lock is moved in the opening direction and, after a period of time, the opening actuator is triggered.

Further advantages, features and details emerge from the following description, in which at least one exemplary embodiment is described in detail—if necessary, with reference to the drawings. Identical, similar and/or functionally identical parts are marked with the same reference numerals.

BRIEF DESCRIPTION OF THE DRAWING FIGURES

Figure 2:
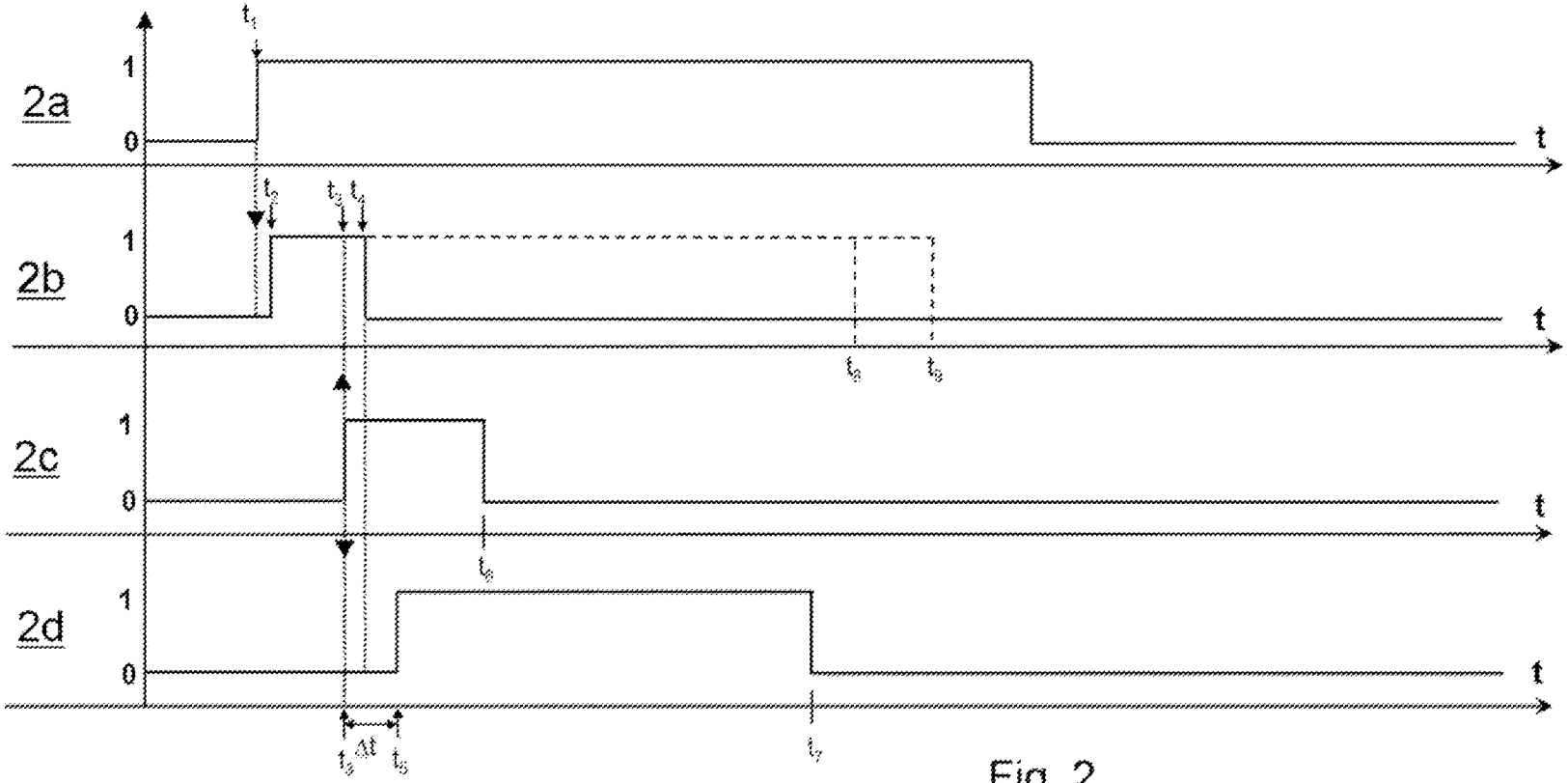
Figure 3:
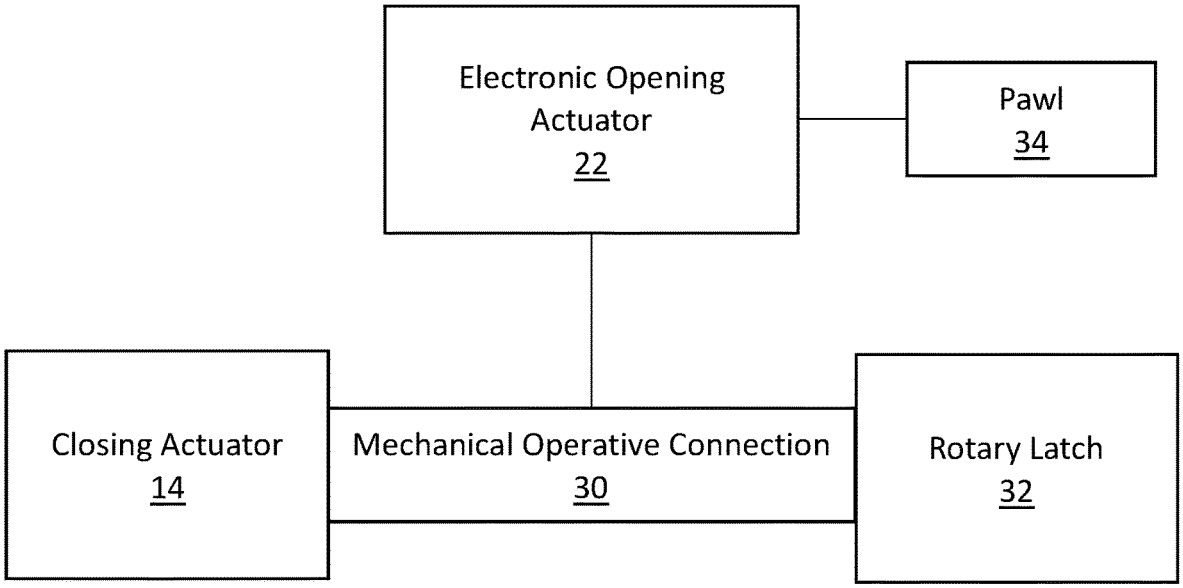

Here are shown:

FIG. 1: a block diagram of a lock operating device for a motor vehicle door, FIG. 2: a circuit diagram for an emergency opening method of the device shown in FIG. 1, FIG. 3: a highly schematic diagram of opening actuator interrupting a mechanical operative connection between a closing actuator and a rotary latch the opening actuator unlocking a pawl of a door lock.

DETAILED DESCRIPTION

FIG. 1 shows a block diagram of lock operating device 10 for a motor vehicle door (not depicted), comprising a door lock 12 which is mechanically coupled to an electrically operated closing actuator 14, preferably via a first Bowden cable 16. Alternatively, the mechanical coupling between door lock 12 and closing actuator 14 can be achieved in another way, e.g., via gears or a push rod.

The door lock 12 has a pre-locking position (not depicted), in which a not-depicted latch (preferably a rotary latch) engages in a bodywork-sided lock clamp. The door lock 12 enters this pre-locking position by a user pushing or pulling the vehicle door closed. In the pre-locking position, the vehicle door is not yet completely closed, but rather has a distance of a few (preferably 4-10) millimeters from a final-locking position in the region of the door lock 12. In the final-locking position, the vehicle door is closed completely and in a sealed manner against the force of the door seals and locked by a not-shown pawl which is then engaged. In order to move from the pre-locking position to the final-locking position, the latch is turned by the closing actuator 14, wherein the rotary latch takes the lock clamp along the aforementioned distance.

The door lock 12 comprises a rotary latch switch 18, which switches over when the rotary latch reaches the pre-locking position. The rotary latch switch 18 is coupled to a control device 20 in such a way that the control device 20, which is coupled to the closing actuator 14 for controlling it, activates the closing actuator 14 as soon as the rotary latch switch 18 triggers. The door lock 12 is thereby moved from the pre-locking position to the final-locking position, which typically takes several hundred milliseconds (e.g., 700 msec).

The lock operating device 10 further comprises an electric opening actuator 22, which is also mechanically coupled to the door lock 12, preferably via a second Bowden cable 24, and which is arranged and designed to interrupt the mechanical operative connection 30 between the closing actuator 14 and the rotary latch 36 of the door lock 12 and to unlock a pawl 34 of the door lock 12, which is illustrated in the highly schematic diagram of FIG. 3. Depending on the design of the door lock 12, this will occur in constructively different ways. In most cases, the door locks 12 comprise a drive latch that engages with the rotary latch 36 during the closing process and is disengaged by means of the opening actuator 22. Furthermore, a pawl 34 is unlocked by means of the opening actuator 22, the pawl 34 having automatically jumped into a locked position in a spring-loaded manner during the closing process, when the rotary latch 36 reaches the final-locking position. This allows the rotary latch 36 to turn back freely and release the lock clamp.

The lock operating device 10 further comprises a door handle 26 mounted on the outside of the vehicle door and provided with a door handle switch 28, wherein a pull on the door handle switches the door handle switch 28 after a short distance. The door handle switch 28 is coupled to the control device 20, which in turn is coupled to the opening actuator 22 to control it. In addition, a second door handle with a door handle switch (not depicted) or a separate switch 30, which is also coupled to the control device 20, can also be provided on the inside of the vehicle door. If one of the switches 28 or 30 is actuated, the control device 20 immediately switches the closing actuator 14 to reverse operation (reversing operation), in which the first Bowden cable 16 is unloaded. In this way, the mechanism inside the door lock 12 is unloaded. If the door lock 12 is in the final-locking position, nothing else occurs at first, since the above-mentioned pawl still remains in the locked position. If, on the other hand, door lock 12 is still in the closing process, i.e., the final locking position has not yet been reached, the door lock 12 starts to move back in the direction of the pre-locking position due to internal spring forces.

By actuating the switches 28 or 30, the control device 20 simultaneously activates a timer device 32 which, after the specified time period, which is between 20 msec and 200 msec, preferably between 60 msec and 120 msec, activates the opening actuator 22. This acts via the second Bowden cable 24 on the door lock 12 and disengages the pawl and interrupts the active connection of the first Bowden cable 16 to the door lock 12.

In FIG. 2, a multiple switch diagram for an emergency opening process of the device shown in FIG. 1 is depicted in a state in which the door lock 12 is still in the closing process, i.e., the final locking position has not yet been reached.

The abscissa of all diagrams is the time, which is the same in all diagrams. In FIG. 2 at the top of diagram 2*a*, the switching state of the rotary latch switch 18 is depicted. In diagram 2*b* below, the switching state of the closing actuator 14 is depicted. In diagram 2*c* below, the switching state of the door handle switch 28 is depicted. In the bottommost diagram 2*d*, the switching state of the opening actuator 22 is depicted.

The starting point is a vehicle door in a closing movement initiated by the user, wherein at a point in time $t_1$ the rotary latch switch 18 switches over, which occurs when the door lock 12 reaches the pre-locking position. After a very short period of time, in particular the period of time required for switch debouncing, the closing actuator 14 is activated at a point in time $t_2$ (diagram 2*b*), which moves the door lock 12 from the pre-locking position to the final-locking position via the first Bowden cable 16. Now, before reaching the final-locking position, the door handle switch 28 is actuated by actuating the door handle 26 (diagram 2*c*), which in turn reverses the closing actuator 14 at a point in time $t_4$ after a very short period of time, which is in particular necessary for switch debouncing.

The opening actuator 22 is only put into operation at a point in time $t_5$ ($\Delta t = t_5 - t_3$) after the time span $\Delta t$ predetermined in accordance with the time switching device 32 according to the invention.

When the door handle 26 is released again (point in time $t_6$) and the door handle switch 28 switches over again, this has no effect on the operation of the opening actuator 22, which is only switched off again by the control device 20 after the end of the opening movement at the point in time $t_7$, when the door lock 12 is again in the pre-locking position.

In FIG. 2, a dashed line in diagram 2*b* depicts the course when the door handle 26 was not operated (at a point in time $t_3$, no switching signal was generated in the door handle switch 28). Then the door lock 12 reaches the final locking position at a point in time $t_7$, and after that, the closing actuator 14 is switched off by the control device 20 at a point in time $t_9$. The point in time $t_8$ (or the time period $t_8-t_2$) can either be pre-set in the control device 20 or a further switch can be provided in the door lock 12 to mark the final locking position. The limit switch-off of the closing actuator 14 at a point in time $t_9$, which is clearly after $t_8$, serves to ensure that the latching pawl of the door lock 12 engages securely.

In addition to the electromechanical coupling via the opening actuator 22 and the second Bowden cable 24, the door handle 26 can be coupled in parallel with the door lock 12 purely mechanically, for example, via a further Bowden cable or a Y-shaped Bowden cable 24, which is connected both to the opening actuator 22 and directly to the door handle 26. In such a case, a second emergency opening function is provided, which forces the door to be opened immediately if the advantages caused by the delay are waived.

In the embodiment described above, when the door handle is operated, the control device 20 always maintains the predetermined time period before the opening actuator 22 is activated. However, within the scope of the invention, it is equally possible to pre-switch the time switching device 32 before an activation of the opening actuator 22 only if the control device 20 has activated the closing drive 14, i.e., the door lock 12 is just about to move from the pre-locking position to the final locking position. If, in this design, the closing actuator 14 is not activated, the opening actuator 22 is immediately activated when the door handle switch 28 gives an opening signal.

Although the invention has been further illustrated and explained in detail by preferred exemplary embodiments, the invention is not restricted by the disclosed examples and other variations can be deduced by the person skilled in the art without leaving the scope of protection of the invention. It is thus clear that there is a wide range of variation possibilities. It is also clear that the designs given as examples are really only examples which are not in any way to be understood as limitations of the scope of protection, the possible applications or the configuration of the invention. Rather, the preceding description and the figure description enable the person skilled in the art to implement the exemplary embodiments in a concrete way, wherein the person skilled in the art, being aware of the disclosed inventive idea, can make various changes, for example with regard to the function or the arrangement of individual elements mentioned in an exemplary embodiment, without leaving the scope of protection which is defined by the claims and their legal equivalents, such as further explanations in the description.

The invention claimed is:

1. A device for opening and closing a motor vehicle door having a door lock, the device comprising:

an electric opening actuator;

an electric closing actuator configured to bring the door lock from a pre-locking position into a final-locking position; and a control device configured to control the opening and closing actuators, wherein the control device is configured, responsive to a door opening request during operation of the closing actuator, to first switch the closing actuator into a reversing mode in which a coupling between the electronic closing actuator and the door lock is unloaded and in which the door lock is moveable again in an opening direction, and then the opening actuator is activatable via a switching signal triggered by a door handle only after a predetermined amount of time, specified by a timer device, after the switching signal triggered by the door handle, and wherein the door handle is mechanically coupled to the door lock, and the door handle and the opening actuator are connected in parallel to the door lock.

2. The device of claim 1, wherein the predetermined period of time is between 60 msec and 120 msec.

3. The device of claim 1, wherein the opening actuator is activatable via another switching signal, which is triggered by a switch mounted in an interior of the vehicle interior.

4. The device of claim 1, wherein the opening actuator is activatable via another switching signal, which is triggered by a programmed control system.

5. The device of claim 1, wherein the door lock includes a rotary latch that engages in a lock clamp on a body of the vehicle in the pre-locking position.

6. The device of claim 5, wherein the opening actuator interrupts a mechanical operative connection between the closing actuator and the rotary latch and unlocks a pawl of the door lock.

7. The device of claim 1, wherein when the closing actuator is not activated, the opening actuator is immediately activated responsive to an opening signal triggered by the door handle.

8. A motor vehicle door, comprising:

a door lock; and device for opening and closing the motor vehicle door, the device comprising an electric opening actuator;

an electric closing actuator configured to bring the door lock from a pre-locking position into a final-locking position; and a control device configured to control the opening and closing actuators, wherein the control device is configured, responsive to a door opening request during operation of the closing actuator, to first switch the closing actuator into a reversing mode in which a coupling between the electronic closing actuator and the door lock is unloaded and in which the door lock is moveable again in an opening direction and then the opening actuator is activatable via a switching signal triggered by a door handle only after a predetermined amount of time, specified by a timer device, after the switching signal triggered by the door handle, and wherein the door handle is mechanically coupled to the door lock, and the door handle and the opening actuator are connected in parallel to the door lock.

9. The motor vehicle door of claim 8, wherein the door lock includes a rotary latch that engages in a lock clamp on a body of the vehicle in the pre-locking position.

10. The motor vehicle door of claim 9, wherein the opening actuator interrupts a mechanical operative connection between the closing actuator and the rotary latch and unlocks a pawl of the door lock.

11. The motor vehicle door of claim 8, wherein when the closing actuator is not activated, the opening actuator is immediately activated responsive to an opening signal triggered by the door handle.

12. A motor vehicle, comprising:

at least one motor vehicle door, which comprises a door lock; and device for opening and closing the motor vehicle door, the device comprising an electric opening actuator;

an electric closing actuator configured to bring the door lock from a pre-locking position into a final-locking position; and a control device configured to control the opening and closing actuators, wherein the control device is configured, responsive to a door opening request during operation of the closing actuator, to first switch the closing actuator into a reversing mode in which a coupling between the electronic closing actuator and the door lock is unloaded and in which the door lock is moveable again in an opening direction and then the opening actuator is activatable via a switching signal triggered by a door handle only after a predetermined amount of time, specified by a timer device, after the switching signal triggered by the door handle, and wherein the door handle is mechanically coupled to the door lock, and the door handle and the opening actuator are connected in parallel to the door lock.

13. The motor vehicle of claim 12, wherein the door lock includes a rotary latch that engages in a lock clamp on a body of the vehicle in the pre-locking position.

14. The motor vehicle of claim 13, wherein the opening actuator interrupts a mechanical operative connection between the closing actuator and the rotary latch and unlocks a pawl of the door lock.

15. The motor vehicle of claim 12, wherein when the closing actuator is not activated, the opening actuator is immediately activated responsive to an opening signal triggered by the door handle.

* * * * *